US011110564B2

(12) United States Patent
Draese et al.

(10) Patent No.: US 11,110,564 B2
(45) Date of Patent: Sep. 7, 2021

(54) METHOD AND DEVICE FOR STRUCTURALLY CONDITIONING A ROLL

(71) Applicants: Stephan Draese, Nettetal (DE); Jan Hendrik Holtz, Krefeld (DE)

(72) Inventors: Stephan Draese, Nettetal (DE); Jan Hendrik Holtz, Krefeld (DE)

(73) Assignee: Hydro Aluminium Rolled Products GmbH, Grevenbroich (DE)

( * ) Notice: Subject to any disclaimer, the term of this patent is extended or adjusted under 35 U.S.C. 154(b) by 87 days.

(21) Appl. No.: 15/614,178

(22) Filed: Jun. 5, 2017

(65) Prior Publication Data

US 2017/0348822 A1 Dec. 7, 2017

(30) Foreign Application Priority Data

Jun. 7, 2016 (EP) ..... 16173305

(51) Int. Cl.

| | |
|---|---|
| ***B24B 39/04*** | (2006.01) |
| ***B21B 28/02*** | (2006.01) |
| ***B21B 27/00*** | (2006.01) |
| ***B21B 27/02*** | (2006.01) |
| *B21B 3/00* | (2006.01) |

(52) U.S. Cl.

CPC ..... *B24B 39/045* (2013.01); *B21B 27/00* (2013.01); *B21B 27/021* (2013.01); *B21B 28/02* (2013.01); *B21B 27/005* (2013.01); *B21B 2003/001* (2013.01); *B21B 2267/26* (2013.01)

(58) Field of Classification Search

CPC ..... B24B 39/045; B24B 39/04; B21B 27/021; B21B 28/02; B21B 27/00; B21B 2003/001; B21B 2267/26; B21B 27/005; B21B 28/04; Y10T 29/49565; B23H 9/04; B23P 1/02

See application file for complete search history.

(56) References Cited

U.S. PATENT DOCUMENTS

| | | | | |
|---|---|---|---|---|
| 3,878,353 A * | 4/1975 | Anderson | ..... | B21B 28/02 219/69.17 |
| 4,452,647 A * | 6/1984 | Sailas | ..... | B21B 27/00 148/321 |
| 2014/0060700 A1 | 3/2014 | Sheu et al. | | |
| 2017/0131193 A1* | 5/2017 | Yamamoto | ..... | G01V 8/20 |

FOREIGN PATENT DOCUMENTS

| | | |
|---|---|---|
| DE | 20 28 022 A1 | 12/1971 |
| DE | 10 2004 008 728 A1 | 9/2005 |
| DE | 10 2013 105 399 A1 | 11/2014 |
| WO | WO 2012/000463 A1 | 1/2012 |

OTHER PUBLICATIONS

A. Rodríguez , L.N. López de Lacalle, A. Celaya, A. Lamikiz, J. Albizuri, Surface improvement of shafts by the deep ball-burnishing technique, Surface & Coatings Technology 206 , 2817-2824. (Year: 2012).*

* cited by examiner

*Primary Examiner* — Jun S Yoo

(74) *Attorney, Agent, or Firm* — Reinhart Boerner Van Deuren P.C.

(57) ABSTRACT

The object of providing a method for conditioning a working roll with which the material properties of a working roll can be set in a process-reliable and uniform manner is achieved by a method in which a roll and at least one pressure tool are rotated relative to each other, in which pressure is applied locally to the roll by means of the at least one pressure tool, comprising at least one pressure element, via the at least one pressure element, and in which a deep rolling process is carried out.

18 Claims, 3 Drawing Sheets

METHOD AND DEVICE FOR STRUCTURALLY CONDITIONING A ROLL

CROSS-REFERENCE TO RELATED PATENT APPLICATION

This patent application claims priority to European Application No. 16173305.0, filed Jun. 7, 2016, the entire teachings and disclosure of which are incorporated herein by reference thereto.

FIELD OF INVENTION

The invention relates to a method for structurally conditioning a roll. The invention further relates to a device for structurally conditioning a roll by carrying out this method using a pressure tool and using a means for rotating a roll relative to the pressure tool. The invention further relates to a roll for deforming materials.

BACKGROUND OF INVENTION

Rolls arranged in roll stands serve for the plastic deformation of materials. The rolls, in particular the working rolls of roll stands for hot or cold rolling of metal strips are preferably with the roll body in direct contact with the surface of the material during the rolling process and serve for the shaping of the rolled product by transferring pressure. Rolls are for example used in the manufacture of metal strips and metal foils wherein materials such as aluminium, steel or their alloys and NE metals are deformed.

Accordingly, high requirements are placed on the structure of rolls. In addition to a high surface quality, for example a homogenous, faultless surface or a defined surface roughness, the mechanical properties of the rolls must be designed, for example for rolling off different materials, in particular hard and thin materials. Unevenness in the material to be rolled can subject the rolls to high stress, in particular the working rolls. It is for example problematic when fold formation, i.e. material overlapping occurs in the rolling gap during rolling. This may for example happen during initial winding and inserting the start of the strip into the rolling gap. Thickened portions develop in the strip to be rolled due to material overlaps which may damage the working rolls during rolling in such a way that for example impressions of these material overlaps can be discerned in subsequently rolled strip regions. These damages are therefore particularly problematic when for example working rolls of finishing rolling passes are concerned. In this respect, it is necessary to provide working rolls which are resistant to corresponding defects.

It is essential for the quality of the structure of the rolls and thus for a reliable rolled result is not only the surface hardness, but also the residual stress of the material of the roll. This results from the stress curve of the material of the roll in the radial direction, i.e. up to the depth of the material.

A certain surface hardness and residual stress are usually set to the extent possible when manufacturing the roll. However, what is problematic is that the rolls are subject to wear after a certain duration of usage and therefore have to be regularly reground. Thereby, both the surface roughness and the residual stress of the material of the rolls change. This can lead to rolling errors reoccurring and the rolls have to be replaced or reselected and assigned to other work steps, e.g. pre-rolling steps. The problem can even occur with newly manufactured rolls that they comprise variations from roll to roll and/or over the roll body length of the roll in the surface hardness and residual stress. Newly used rolls thus also have to be pre-sorted and are suitable initially only for certain work steps, for example for a pre-rolling step or for rolling passes with low pass reduction rates.

Therefore, the handling of rolls, in particular of working rolls in a rolling mill is relatively complex. Both new and used and reground working rolls have to be regularly checked with respect to the surface quality or hardness and reclassified with respect to the suitability for certain rolling passes. For example, only certain rolls with a certain surface hardness and a specific near-surface residual stress profile are suitable for a rolling pass with a high reduction rate or a last, surface-giving rolling pass. Other rolls do not reach the surface hardness and the residual stress profile in the edge layers and tend further to the described rolling defects.

BRIEF SUMMARY OF INVENTION

The object of the present invention is to provide a method for treating a roll with which the material properties of a roll can be set in a process-reliable and uniform manner. Furthermore, a device for carrying out the method and an advantageous roll will be proposed.

The object is achieved by a method in which a roll and at least one pressure tool are rotated relatively to each other, in which pressure is applied locally to the roll by means of at least one pressure tool, comprising at least one pressure element, via the at least one pressure element and in which the at least one pressure tool and the working roll are moved in an axial direction of the working roll relative to each other with a feed motion such that a pressure is applied to at least one surface section of the roll via the at least one pressure element.

Hereinafter it is always referred to a pressure tool with a pressure element. Thereby, in each case the at least one pressure tool and the at least one pressure element is meant.

Since pressure is locally applied to the roll via the pressure element, not only the surface hardness can be set by a cold work hardening of the edge layers. Moreover, the residual stress of the material can also be specifically influenced near to the surface. It has been found that the homogenous and defined setting of the near-surface residual compressive stresses of the roll body can decisively change the properties of the roll up to a depth of approximately 0.2 to 0.3 mm. The method according to the invention ensures this in a reproducible manner. This is in contrast to hardening processes that are otherwise conventional in connection with rolls, for example inductive progressive hardening processes. In the case of inductive progressive hardening, hardening of the roll body can be achieved via a stepwise inductive annealing and subsequent quenching, defined setting of the residual stress in the edge layers or near-surface regions of the roll body cannot, however, be achieved hereby. This also essentially applies to the total roll body hardening process in which the entire roll body is annealed and quenched. At the same time, a particularly smooth surface with low roughness can be set via the cold work hardening by means of the described process.

The pressure element applies pressure locally on the roll. The roll and the pressure tool are rotated relative to each other. At the same time, the pressure tool is moved at least along a section of the roll at least partially in the axial direction of the roll. A flat section of the roll can thus be conditioned. The relative movement of the pressure tool can hereby run for example parallel to the roll axis. In order to build up a uniform pressure, the pressure tool can for example follow the contour of the surface of the roll in some areas. However, other possibilities are also conceivable to build up a constant pressure over the contour course of the roll. The roll is preferably rotated in a fixed manner and the pressure tool moves in the axial direction of the roll.

As a result of the fact that the application of pressure is localised in a small operating region, very precisely defined process conditions can be set. At the same time, the localised operating region is moved by means of the combination of rotation and feed motion over a section of the working roll. The material properties, in particular the surface hardness can thus be set via a hardening of the edge layers and the course of the residual stress in the near-surface regions can be set particularly uniformly on the conditioned surface section of the roll.

The method described here thus advantageously combines setting of the surface hardness by a cold work hardening of the edge layers and setting the residual stress in the near-surface regions, i.e. the edge layers with the provision of a particularly uniform surface wherein these properties can be achieved very homogenously and in a process-reliable manner.

Conditioning of the work surface, i.e. the roll body of a working roll is particularly advantageous. The roll surfaces for example of working rolls are subject to high material requirements during use which can be set by means of the method described. The conditioned surface section can also extend substantially over the entire surface of the working roll. In addition to the roll body of a roll or a working roll, mounting surfaces can also be conditioned.

It is possible to set the material properties of rolls that have already been used and for example are reground for further use. It has been found that using the method described, a surface hardness, in particular in the roll body of a working roll can be set which is similar to the surface hardness of the rolls in new condition or even surpasses this surface hardness. At the same time, the residual stress in the near-surface edge layer is increased such that an impression of surface patterns can be eliminated, for example in the case of material overlaps. As already mentioned, rolls, which are in new condition, are also often subjected to strong fluctuations in hardness and residual stress. By conditioning using the described method, even new rolls can be uniformly set with respect to the mechanical properties which facilitates the selection of the rolls for the rolling passes.

The pressure tool in particular comprises a deep rolling tool or a deep rolling process is carried out in the method. Deep rolling must be distinguished from the methods, roller burnishing and rolling. Roller burnishing comprises the setting of a high surface quality in relation to the smoothness of the surface, wherein the material is not influenced or only slightly influenced with regard to the surface hardness and the near-surface residual stress. In the case of rolling, the surface of the working roll is removed by fine machining with roughened tool surfaces. In contrast, deep rolling is not a machining process. Surface hardening and increase of the residual stress in the near-surfaces regions is effected.

Preferably, according to a first embodiment of the method, a working roll of a roll stand is conditioned for hot or cold rolling of metal strips, in particular metal strips made from aluminium or an aluminium alloy. It has been found that working rolls can be hereby specifically prepared or processed for certain rolling areas, e.g. pre-rolling passes or finishing rolling passes. The correspondingly conditioned working rolls clearly exhibit fewer problems in relation to the impression of surface patterns in the case of previous fold formation or material overlap, for example in the case of initial winding or threading of the strip or foil in the rolling gap in the further rolling process.

A working roll consisting at least partially or completely of steel is conditioned using the method described. The surface of the working roll can in this case preferably consist partially of martensitic steel. Martensitic steel is in particular suitable for use in working rolls due to its strength properties and can be advantageously set in its structure and residual stress using the described method.

In one configuration of the method, a surface-removing process is also carried out on the roll. The method according to the invention can for example be combined with a smoothing of the roll, as is usually carried out at certain intervals during the rolling operation. For example, grinding or milling of the roll surface can be carried out in combination with the method according to the invention. The surface-removing process can be carried out prior to or after using the pressure tool. Preferably, the surface-removing process is carried out after using the pressure tool in order to prepare the surface of the roll for carrying out subsequent rolling processes. In relation to the process times, it is advantageous for a surface-removing process to be carried out simultaneously to the treatment by the pressure tool, for example a grinding tool or milling tool can be arranged next to the pressure tool and be moved simultaneously with the feed motion in order to process the roll.

In a further configuration of the method, a pressure element to which pressure is applied and comprising a rotatable ball or a rotatable cylindrical roller is used. The ball or roller consists in particular of a hard metal or a ceramic. Low wear both of the pressure element and of the roll surface is achieved by the rotatable arrangement and a higher surface quality is achieved. The ball or roller can be arranged in a housing and be located at one side of the housing in contact with the roll, while pressure is applied to the ball or roller from the opposing side, said pressure being generated hydraulically or pneumatically. As a result, there is a simple possibility for exerting a controllable pressure on the surface of the roll. At the same time, balls or rolls provide a very small operating surface which is in contact with the roll, whereby a very high pressure can be exerted on the surface of the roll, for example the working surface of a working roll and thus a high penetration depth of the structural change of the steel is ensured.

Smaller diameters of the ball or roller lead to higher pressure on the surface of the roll. However, at the same time the process speed tends to decrease with smaller diameters since smaller feed motions have to be used. In order to achieve a deep setting of the residual stress with high process speeds, the diameter of the ball or the roller is preferably 3 to 30 mm. Diameters of the ball or the roller of 6 to 13 mm have been further proven as advantageous for carrying out the process. If the diameter is at least 10 mm here, very high process speeds can already be achieved.

In a further configuration of the method, the pressure of at least 100 bar is applied to the pressure element. With such minimum pressure, a large penetration depth can already be achieved for setting the residual stress of the roll and even greater surface hardnesses are achieved. This pressure is applied to the pressure element. The pressure applied to the surface of the roll via the pressure element may be notably greater depending on the dimensioning of the pressure element.

Even higher pressures can be used for higher requirements for the conditioning of the roll. Pressure of at least 200 bar or at least 300 bar is in particular applied on the pressure element. If the pressure on the pressure element is at least 400 bar, a further significant increase of the surface hardness as well as the near-surface residual stress can be achieved. A pressure of 1000 bar could be considered an upper limit since it is assumed that rolls are conditioned in this range in practice. Higher pressures are also in principle conceivable.

The pressure on the pressure element can be provided by a hydraulic device, for example using a hydraulic fluid.

In one configuration of the method, a lubricant is used for the pressure tool and the roll. As a result, the wear on the pressure element and the roll is reduced and a higher surface quality is achieved. A grinding emulsion can for example be used here as the lubricant. Such a grinding emulsion is in particular used in the provision of the pressure on the pressure element in a hydraulic device. The pressure tool is thus simultaneously supplied with lubricant by applying a pressure. In addition, soiling which disrupts or impairs downstream processes also does not occur on the roll. The method according to the invention can be easily integrated into the existing processes machining the surfaces of the rolls, such as grinding the rolls and the devices required therefor.

In one configuration of the method, a feed motion of 0.01 mm to 4 mm, preferably 0.1 to 0.4 mm is used per revolution of the roll. The feed motion is determined based on the speed of the pressure tool in relation to the roll and is set in relation to the rotation of the roll towards the pressure tool. It has been found that using the mentioned range for the feed motion a particularly uniform and deep acting influencing of the residual stress can be achieved with a simultaneously high surface quality. The feed motion is in particular at least 0.2 mm/revolution for a higher production speed.

A range of 100 to 250 revolutions/minute has been found to be advantageous as the rotational speed for the relative rotation of roll and pressure tool. This range allows a uniform treatment with high process speeds.

The specific ranges for the diameter of the ball or roller of the pressure element, the feed motion and the pressure can be advantageously combined with each other. A ball diameter of 3 to 16 mm, a feed motion of 0.1 to 0.4 mm/revolution at a pressure of 100 to 450 bar has been found to be a particularly noteworthy combination. Further preferred combinations of ball diameters d, pressure and feed motion are represented in the following Table 1 as a function of the difference in hardness Δ HLE that is to be achieved.

The measurement values for the hardness according to Leeb hardness test are determined in accordance with DIN 50156. According to DIN 50156, a distinction is made between the impactor types D/DC, DL, S and E and the measurement value is labelled with the respective impactor type. Measurements of low hardness regions are usually carried out with the impactor type D/DC and labelled with HLD or HLDC (<500 HLD). In the case of high Leeb hardness values, the impactor type E or S is used. The hardness values indicated in HLE are at or above 800 HLE.

TABLE 1

| Δ HLE/Δ HLD | d Ball (mm) | Pressure (bar) | Feed motion (mm/U) |
|---|---|---|---|
| 10 | 3-10 | 100-160 | 0.2-0.3 |
| 20 | 3-10 | 250-330 | 0.2-0.3 |
| 25 | 10-16 | 220-290 | 0.2-0.3 |
| 30 | 10-16 | 300-380 | 0.3-0.5 |
| 35 | 10-16 | 320-400 | 0.2-0.3 |
| 40 | 10-16 | 350-450 | 0.2-0.3 |

For the sake of simplicity, differences of the Leeb hardness are always indicated as HLE hereinafter, although an impactor of the type D and thus HLD would have to be indicated for lower absolute values. In the case of differential values, the HLE value thus substantially denotes differential values which are measured with a different impactor type, for example a type D impactor.

In a subsequent configuration of the method, an increase of the Leeb hardness of the surface of at least 10 HLE is effected in the processed section of the roll. The Leeb hardness can be easily determined with a rebound hardness test. An increase of 10 HLE can provide rolls that have already been used with a surface hardness which is equal to or greater than that of the delivery condition. It has been found that an increase of at least 25 HLE or at least 35 HLE makes a number of rolls that have already been used suitable once again for different rolling passes, even critical rolling passes. Even hardness increases of at least 40 HLE can be introduced using the described method.

In a further configuration of the method, a hardness test of the roll is also carried out. A hardness test can be carried out via static methods for determining the Brinell, Vickers or Rockwell hardness. As the dynamic hardness test the Leeb hardness can be determined. A hardness test can take place prior to and/or after the conditioning with the pressure tool. A hardness test is also conceivable during the conditioning.

According to a further teaching, the above-mentioned object is achieved by a device for conditioning a roll, comprising at least one pressure tool, which in particular comprises a deep rolling tool, and means for rotating a roll relative to the pressure tool wherein the at least one pressure tool comprises at least one pressure element that is set up to apply pressure locally on the roll and means are provided for moving the pressure tool relative to working roll in the axial direction of the working roll with a feed motion.

As was already discovered with the above-described method, conditioning a roll with the device advantageously combines setting the surface hardness by a cold work hardening of the edge layers and setting the residual stress in the near-surface regions with the provision of a particularly uniform surface wherein these properties can be achieved homogenously and in a process-reliable manner. The method can be easily carried out with the device according to the invention.

In one configuration of the device, at least one means is provided for carrying out a surface-removing process. The conditioning of a roll with a pressure tool can thus for example be combined with smoothening the roll. Grinding or milling the roll surface can also be carried out in combination with conditioning. For example, a surface-removing tool can be arranged next to the pressure tool and can be moved simultaneously with the feed motion in order to process the roll. Preferably, the means for carrying out a surface-removing process are in this case arranged in such a way next to the pressure tool that the surface-removing process can be carried out after the process of conditioning. For example, the means for carrying out a surface-removing process are arranged in the direction of movement behind the pressure tool or the deep rolling tool. In a further configuration of the device, the pressure element comprises a rotatable ball or a rotatable cylindrical roll. The ball or roller in particular consists of a hard metal or a ceramic. By way of the rotatable arrangement, low wear both of the pressure element and of the roll surface is achieved and a higher surface quality is achieved. The ball or roller can be arranged in a housing and be located at one side of the housing in contact with the roll while pressure is applied on the ball or roller from the opposing side, for example hydraulically or pneumatically. As a result, there is a simple possibility of exerting an easily settable pressure locally on the surface of the roll. At the same time, balls or rolls provide a very small operating surface which is in contact with the roll whereby a very high pressure results on the surface of the roll.

The diameter of the ball or the roller is in particular 3 to 30 mm or 3 to 16 mm. Diameters of the ball or the roller of 6 to 13 mm have further been proven to be advantageous for carrying out the process. If the diameter is at least 10 mm here, very high process speeds can already be achieved.

In a further configuration, a pressure source is provided which is set up to apply pressure of at least 100 bar to the pressure element. For further conditioning, a pressure of at least 200 or at least 300 bar can also be provided. If the pressure on the pressure element is at least 400 bar, a further significant increase of the surface hardness and the residual stress can be achieved. Approximately 1000 bar can be considered as the upper limit in practice here. However, even higher values are also conceivable.

The pressure on the pressure element can for example be provided by a hydraulic device.

According to a further teaching, the above-mentioned object is achieved with a roll, in particular a working roll for deforming materials in that the roll comprises at least one surface section, preferably a roll body which has been treated using a method according to the invention. As was already mentioned with regard to the method, setting the surface hardness by a cold work hardening of the edge layers and setting the residual stress up to the depth of the material with the provision of a particularly smooth and uniform surface is combined by way of conditioning wherein these properties are configured particularly homogenously. A specific structure and specific mechanical properties of the roll are thus set with the conditioning. These properties optimise the roll for different rolling processes. The roll preferably comprises working surfaces that are conditioned in this respect which are in direct contact with the rolled product. This applies in particular for the roll body of a working roll.

The treatment using the method results in a particularly uniform distribution of the mechanical surface hardness inside the treated section. According to one configuration of the roll, this is notable in that inside the conditioned surface section, the Leeb hardness of the surface of the roll comprises a maximum standard deviation of 15 HLE, in particular a maximum standard deviation of 7.5 HLE. The standard deviation is a measure for the distribution of the hardness at different points of the surface of the average hardness of the surface. The Leeb hardness is used as a measure for the hardness, as can take place with a dynamic hardness test. The treated section to be considered can be the roll surface, i.e. the roll body of the roll. In order to determine the standard deviation, at least 5 measurement points, in particular at least 10 measurement points should be used. A particularly uniform and process-reliable rolled product is achieved with corresponding standard deviations of the Leeb hardness.

According to a further configuration, the roll is designed as a working roll for rolling strips or foils made from metal, aluminium or an aluminium alloy. In the case of foils or strips, there are high requirements on the rolling quality which can be provided by the working roll. The foils or strips preferably consist of aluminium, aluminium alloys, however, they can also consist of steel.

The treated regions of the roll can comprise a Leeb hardness of at least 500 HLD. Higher hardnesses are also possible, thus Leeb hardnesses of at least 830 HLE or at least 850 HLE can be provided. A preferred range for working rolls for rolling strips or foils made from aluminium or an aluminium alloy is considered between 830 HLE and 880 HLE since these rolls treated according to the invention are resistant with regard to the imprinting of surface patterns due to material overlap of the corresponding metal strips or foils and can still be brought into this condition with good process speed using the method according to the invention.

The treated regions of the roll can have undergone an increase in the Leeb hardness of at least 10 HLE. Greater increases of at least 25 HLE or at least 35 HLE are also possible. The increase in the Leeb hardness is preferably between 10 HLE and 50 HLE.

BRIEF DESCRIPTION OF THE SEVERAL VIEWS OF THE DRAWING

For further configurations of the device and the roll reference is made to the above details regarding the method as well as to the following description and the drawings. In the drawings.

DETAILED DESCRIPTION OF INVENTION

Figure 1:
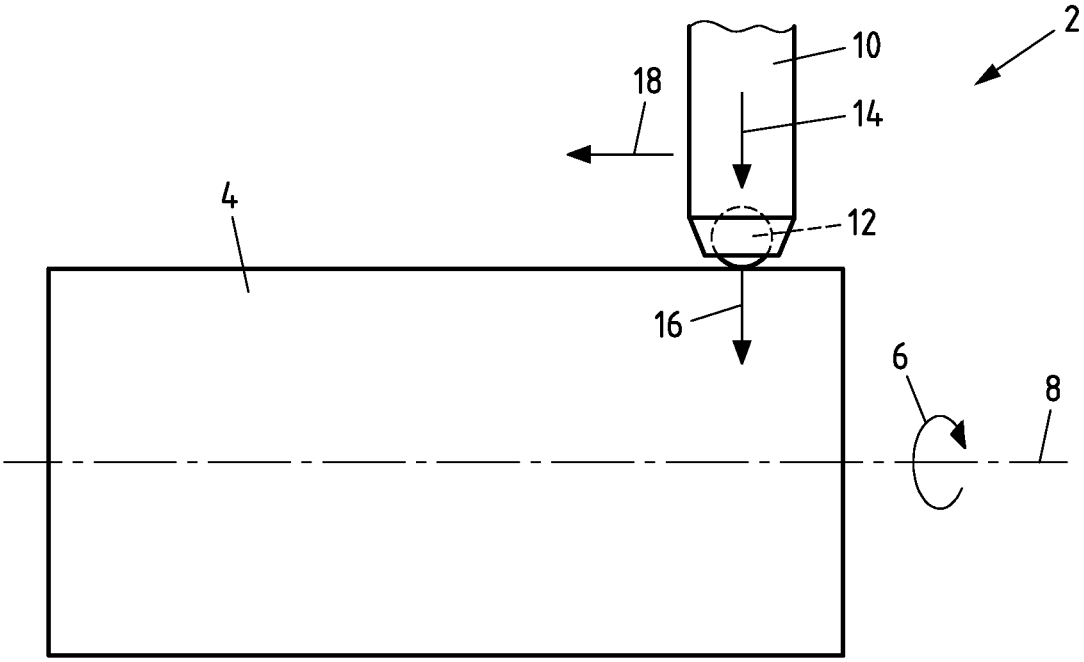
FIG. 1 shows a schematic representation of a device 2 for carrying out the method.

FIG. 1 shows a schematic representation of a device 2 for carrying out the method. A roll 4 is conditioned with the device 2. A means for rotating 6 the roll 4 is provided which allows the roll 4 to be rotated along a roll axis 8 and thus relative to a pressure tool 10. The pressure tool 10 comprises at least one pressure element 12 wherein pressure is applied locally on the working roll 4 by means of the pressure tool 10 via the pressure element 12. A pressure 14 is applied on the pressure element 12 here which is transferred in the form of a pressure 16 to the roll 4. The pressure can be generated hydraulically or pneumatically.

The pressure is applied on the roll 4 only locally at the contact point to the pressure element 12. A means for moving the pressure tool 10 relative to the roll 4 is provided which moves the pressure tool 10 with a feed motion 18 at least along a section of the roll 4 wherein pressure is applied to the section of the roll 4 via the pressure element 12.

A section of the roll 4, for example the roll surface or the mounting surface is thus successively conditioned with a very high pressure 16 by the common rotational movement and the feed motion 18. The conditioning of a roll 4 combines setting the surface hardness by a cold work hardening of the edge layers and setting the residual stress into the depth of the material. At the same time, a particularly smooth and uniform surface is provided. These properties are achieved in a homogenous and process-reliable manner via the conditioned section. In addition, a surface-removing process can, in principle, be carried out with the device 2 on the roll 4. Preferably, in this case a surface-removing process, e.g. grinding or milling, can be carried out with the device 2 on the roll 4 after the conditioning in order to prepare the surface of the roll for carrying out subsequent rolling processes.

Figure 2:
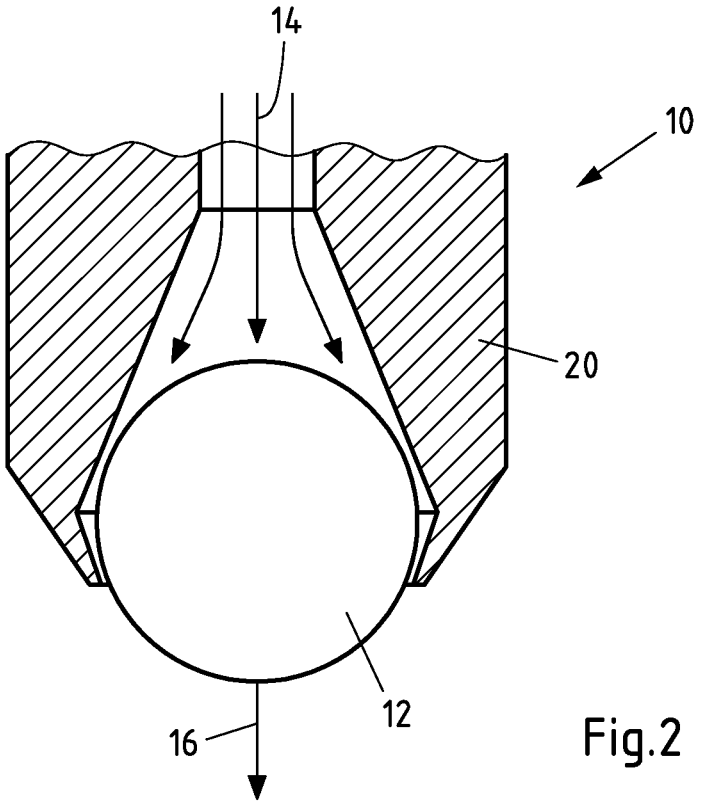
FIG. 2 shows a schematic representation of a pressure tool with a pressure element.

FIG. 2 shows a schematic representation of a pressure tool 10 with a pressure element 12 to illustrate the principle, as they can be used in a method or a device 2 described here. The pressure element 12 is designed as a ball and is arranged in a housing 20. The pressure 14 is provided by a hydraulic device, which is not represented here, and is transferred in the housing 20 to the pressure element 12 with a fluid which comprises for example a grinding emulsion as the lubricant.

While the pressure 14 acts on a larger surface of the pressure element 12, a very small contact surface is defined for the roll 4 by the diameter of the ball-shaped pressure element 12 whereby the local pressure 16 exerted on the roll 4 can be significantly higher than the pressure 14 which applied to the pressure element 12.

The surface hardness by way of a cold work hardening of the edge layers and setting the residual stress into the depth of the material is carried out by a deep rolling process using the pressure tool 10.

Figure 3:
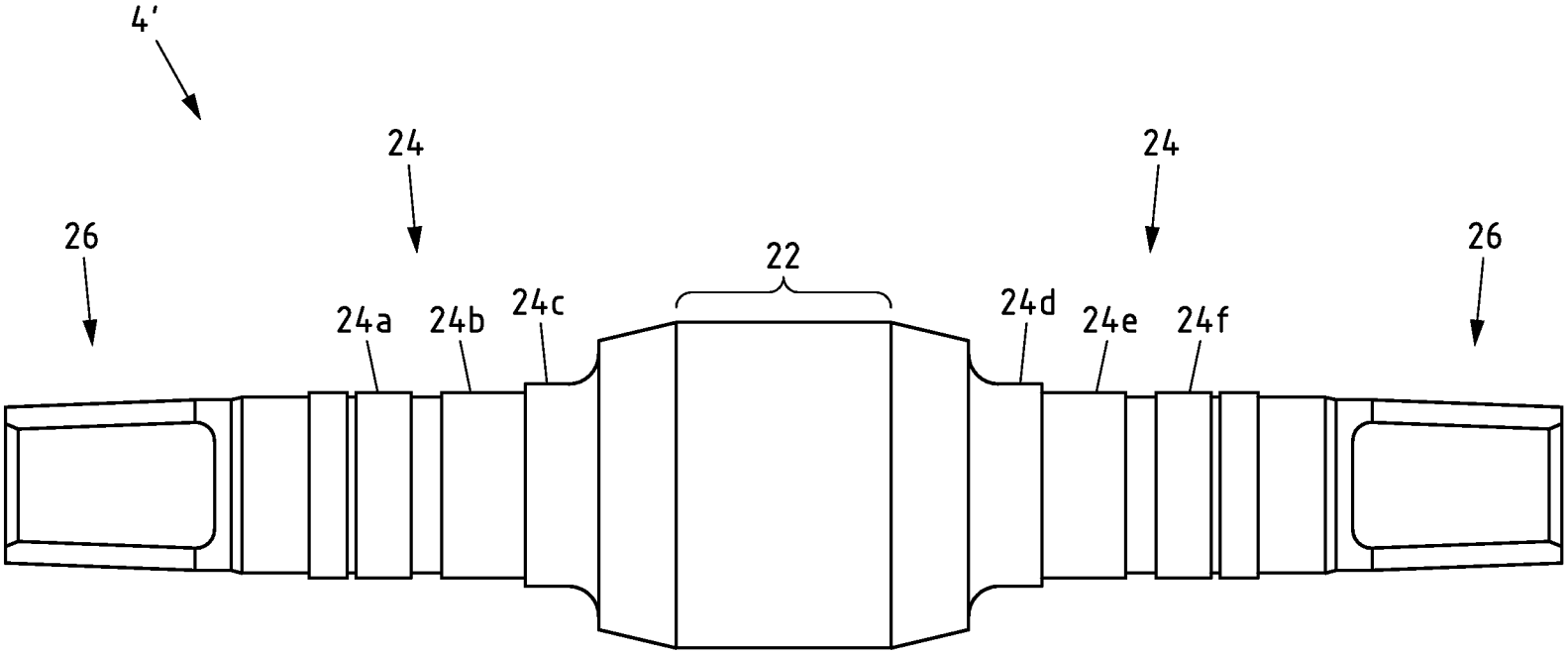
FIG. 3 shows a schematic representation of a working roll.

FIG. 3 shows a schematic representation of a roll 4' which is designed here as a working roll of a roll stand and has been conditioned with a method according to the invention. The working roll 4' comprises a roll body 22, a pin 24 and a pivot point 26 as regions with different functions.

The roll body 22 comprise a roll surface which is usually in direct contact with the material to be rolled in the case of working rolls. The structure of the roll body 22 is thus particularly important for the rolled product such that setting surface hardness and residual stress by conditioning the roll body 22 is advantageous.

Surfaces on the pins 24 can also lend themselves to conditioning. For example, the surfaces 24*a* to 24*f* can serve as mounting surfaces, individually or in combination and thus setting of surface hardness and residual stress can be carried out by conditioning. The same applies for the pivot point 26.

In principle, any sections of the surface which are subject to corresponding structural requirements can be conditioned. Substantially the entire surface of the working roll 4' can also be conditioned.

Test series were carried out on different working rolls in order to examine the effect of the method or the device with respect to the surface hardness. The working rolls were set up to roll foils or strips made from aluminium or aluminium alloys. The Leeb hardness of the surface was measured on already used and newly-smoothed working rolls prior to and after conditioning. In order to determine the Leeb hardness, the measuring device with the designation Eqotip 2 (R) with an impact body E was used, as sold on the application date by the company, Proceq SA (R).

The pressure on the pressure element was varied from 100 bar to 400 bar in a first test series on different sections of the roll body and the Leeb hardness according to DIN 50156 was measured at three positions. A roll body with a diameter of 13 mm was used as the pressure element and a feed motion of 0.2 mm/revolution with a rotational speed of 125 r/min. The results of this test series are recorded in Table 2 and FIG. 4.

TABLE 2

| Pressure (bar) | | Hardness Pos. 1 (HLE) | Hardness Pos. 2 (HLE) | Hardness Pos. 3 (HLE) | Δ HLE |
|---|---|---|---|---|---|
| 100 | Beforehand | 806 | 815 | 811 | 6 |
| | Afterwards | 814 | 818 | 819 | |
| 200 | Beforehand | 817 | 816 | 820 | 18.3 |
| | Afterwards | 836 | 837 | 835 | |
| 300 | Beforehand | 816 | 814 | 815 | 29.3 |
| | Afterwards | 842 | 844 | 847 | |
| 400 | Beforehand | 811 | 807 | 819 | 39.6 |
| | Afterwards | 850 | 855 | 851 | |

Figure 4:
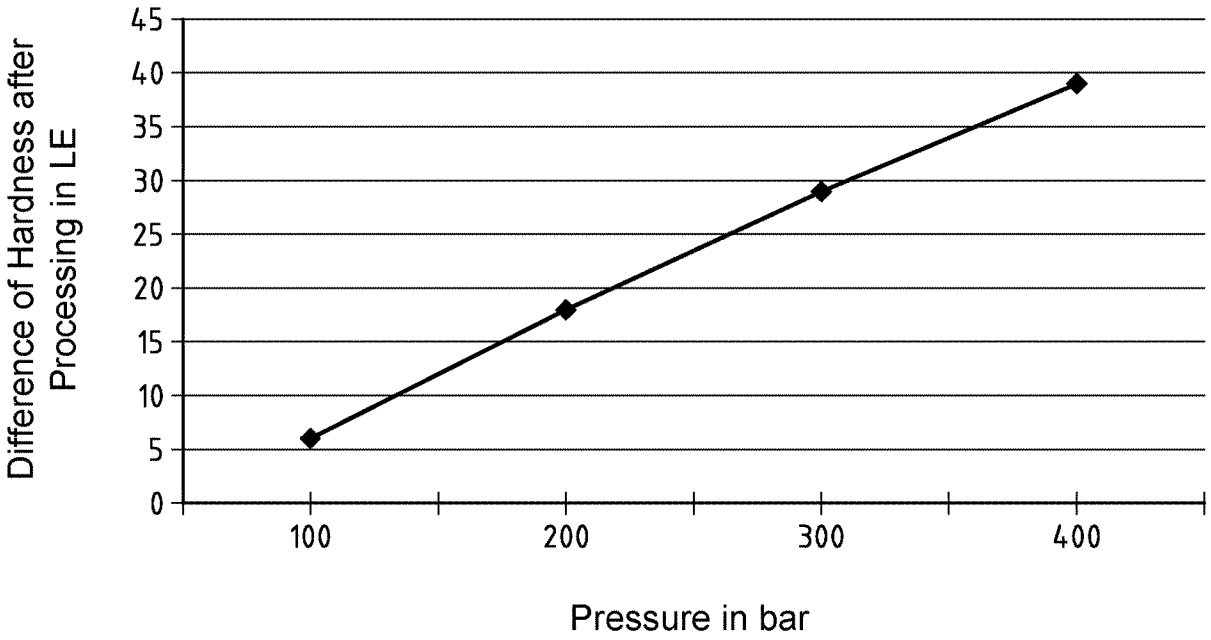
FIG. 4 shows a diagram regarding the difference in hardness achieved under different pressures.

It can hereby be noted that the conditioning effects a uniform increase in the hardness. The increase of the Leeb hardness in FIG. 4 is plotted as a function of the pressure. An increase of 10 HLE can be expected from approximately 150 bar with a 13 mm ball. Increases of at least 25 HLE or at least 35 HLE are also possible. With an identical ball at 400 bar of pressure, an increase of approximately 40 HLE was introduced.

Subsequently, conditioning of the roll body likewise with a 13 mm ball was carried out on two used working rolls with the designations F87 and F88 with a pressure of 400 bar. The Leeb hardness prior to and after the conditioning is recorded in Table 3 for three measuring points, the position of which is indicated in relation to the roll body edges.

TABLE 3

| Working roll | Rotational speed (r/min) | Duration (min) | | Hardness Pos. 200 mm (HLE) | Hardness Pos. 500 mm (HLE) | Hardness Pos. 800 mm (HLE) | Hardness Pos. 1200 mm (HLE) | Hardness Pos. 1500 mm (HLE) |
|---|---|---|---|---|---|---|---|---|
| F87 | 125 | 64 | Beforehand | 823 | 813 | 814 | 818 | 815 |
| | 125 | 64 | Afterwards | 848 | 842 | 841 | 842 | 837 |
| F88 | 200 | 40 | Beforehand | 818 | 817 | 822 | 828 | 828 |
| | 200 | 40 | Afterwards | 848 | 844 | 847 | 846 | 845 |

In this test series also a notable increase in the surface hardness, with which the working rolls are re-conditioned for different usage purposes, was determined.

In order to examine the distribution of the generated hardness over the conditioned surface, the Leeb hardness was determined at different positions a-q of the conditioned roll body. The first position a was in this case spaced 25 mm from the roll body edge. The distance between the further positions was respectively 100 mm. This was respectively carried out on the circumference at four different angular positions P1 to P4, between which the working roll was respectively rotated by 90°. The results thereof are recorded in Table 4, together with the calculated standard deviation of the Leeb hardness by the average value. The unit of hardness here is also HLE.

The values from table 4 show that a particularly uniform structure of the working roll was provided with the conditioning. For working roll F87, the standard deviation of the Leeb hardness was under 15 HLE. For the working roll F88, a standard deviation of below 7.5 HLE was even achieved.

TABLE 4

| | | a | b | c | d | e | f | g | h | i | j | k | l | m | n | o | p | q | SD |
|---|---|---|---|---|---|---|---|---|---|---|---|---|---|---|---|---|---|---|---|
| F87 | P1 | 840 | 849 | 849 | 848 | 850 | 950 | 851 | 851 | 849 | 848 | 847 | 844 | 845 | 845 | 847 | 851 | 842 | 13, 8 |
| | P2 | 839 | 854 | 850 | 852 | 853 | 851 | 852 | 850 | 852 | 851 | 849 | 848 | 849 | 847 | 848 | 848 | 841 | |
| | P3 | 825 | 851 | 851 | 854 | 843 | 848 | 850 | 839 | 839 | 850 | 850 | 843 | 849 | 850 | 849 | 850 | 839 | |
| | P4 | 848 | 848 | 857 | 855 | 856 | 855 | 855 | 855 | 851 | 850 | 849 | 850 | 850 | 848 | 845 | 831 | 823 | |
| F88 | P1 | 828 | 834 | 839 | 849 | 849 | 843 | 843 | 847 | 848 | 848 | 848 | 843 | 848 | 848 | 847 | 844 | 842 | 5, 6 |
| | P2 | 840 | 842 | 845 | 844 | 842 | 845 | 840 | 840 | 839 | 840 | 842 | 844 | 843 | 844 | 834 | 829 | 827 | |
| | P3 | 829 | 830 | 849 | 849 | 849 | 851 | 849 | 843 | 848 | 844 | 843 | 841 | 845 | 844 | 842 | 849 | 845 | |
| | P4 | 847 | 846 | 847 | 846 | 843 | 844 | 836 | 849 | 848 | 848 | 849 | 850 | 850 | 846 | 847 | 844 | 842 | |

In a further detailed test series, the different method parameters for the ball diameter d of the pressure element, the pressure and the feed motion were varied. The rotational speed was here maintained constant with 160 r/min.

Based on this test series, preferred parameter ranges could be established which condition the rolls particularly advantageously. These can be used irrespective of the rotational speed. The ranges are combined in Table 5 as a function of the desired hardness in A HLE.

TABLE 5

| Δ HLE | d ball (mm) | Pressure (bar) | Feed motion (mm/r) |
|---|---|---|---|
| 10 | 3-10 | 100-160 | 0.2-0.3 |
| 20 | 3-10 | 250-330 | 0.2-0.3 |
| 25 | 10-16 | 220-290 | 0.2-0.3 |
| 30 | 10-16 | 300-380 | 0.3-0.5 |
| 35 | 10-16 | 320-400 | 0.2-0.3 |
| 40 | 10-16 | 350-450 | 0.2-0.3 |

The effect of the conditioning on two working roll pairs was also further examined which stood out with complaints in relation to pattern imprints in the rolling process. After conditioning these working roll pairs with the described method and subsequently grinding the roll surface, the working roll pairs could be operated without complaints in relation to the imprinting of surface patterns by material overlaps.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A method for structurally conditioning a roll body of a working roll of a roll stand, comprising the following steps, rotating said roll body of said working roll relative to at least one pressure tool, wherein said pressure tool comprises at least one pressure element, applying a pressure locally to said roll body of said working roll by means of said at least one pressure tool via said at least one pressure element, and moving said at least one pressure tool relative to said roll body of said working roll with a feed motion in the axial direction of said roll body of the working roll such that said pressure is applied to at least one surface section of the roll via the at least one pressure element, whereby a deep rolling process of said roll body of said working roll is carried out.

2. The method according to claim 1, further comprising the step of conditioning said working roll of the roll stand to be suitable for hot or cold rolling of metal strips or foils from aluminium or an aluminium alloy.

3. The method according to claim 1, further comprising a step of carrying out a surface-removing process on the roll body of said working roll after carrying out the deep rolling of said roll body of said working roll.

4. The method according to claim 1, wherein said pressure element comprises a rotatable ball or a rotatable cylindrical roller.

5. The method according to claim 4, wherein the rotatable ball or the rotatable cylinder has a diameter of 3 mm to 30 mm.

6. The method according to claim 4, wherein the diameter of the ball or the roller is from 3 mm to 16 mm.

7. The method according to claim 4, wherein the diameter of the ball or the roller is from 6 mm to 13 mm.

8. The method according to claim 1, further comprising the step of applying said pressure to the pressure element with at least 100 bar.

9. The method according to claim 1, wherein the feed motion of the pressure element is 0.01 mm/revolution to 4 mm/revolution of the working roll.

10. The method according to claim 1, wherein a Leeb hardness of the surface is increased at least 10 HLE in a processed section of the roll.

11. The method according to claim 1, wherein the feed motion of the pressure element is 0.1 mm/revolution to 0.4 mm/revolution of the working roll.

12. A device for structurally conditioning a roll body of a working roll of a roll stand by carrying out a method according to claim 1, comprising:

a pressure tool, wherein said working roll is rotated relative to said pressure tool, said pressure tool comprises at least one pressure element, said at least one pressure element is suitable to apply a pressure locally on said roll body of said working roll, wherein the pressure tool comprises a deep rolling tool to carry out a deep rolling process to said roll body of said working roll; and wherein the pressure tool is configured to move relative to the working roll in an axial direction of the working roll.

13. The device according to claim 12, further comprising a surface removal tool configured to remove at least a portion of the surface of the working roll.

14. The device according to claim 12, wherein said at least one pressure element comprises at least one rotatable ball or at least one rotatable cylindrical roller to which pressure can be applied.

15. The device according to claim 12, wherein a pressure source is provided with which pressure of at least 100 bar can be applied to the at least one pressure element.

16. A working roll of a roll stand for hot or cold rolling metal strips, wherein the working roll comprises a roll body which has been treated using a method according to claim 1, wherein a conditioned surface section comprises a Leeb hardness of the surface of the roll body of the working roll with a standard deviation of 15 HLE.

17. The working roll according to claim 16, wherein the working roll is designed as a working roll for rolling foils or strips made from aluminium or an aluminium alloy.

18. A working roll of a roll stand for hot or cold rolling metal strips, wherein the working roll comprises a roll body which has been treated using a method according to claim 1, wherein a conditioned surface section comprises a Leeb hardness of the surface of the roll body of the working roll with a maximum standard deviation of 7.5 HLE.

* * * * *